US010205253B2

(12) United States Patent
Kitagawa et al.

(10) Patent No.: US 10,205,253 B2
(45) Date of Patent: Feb. 12, 2019

(54) GROUNDING TERMINAL FITTING

(71) Applicant: Sumitomo Wiring Systems, Ltd., Yokkaichi, Mie (JP)

(72) Inventors: Yuji Kitagawa, Mie (JP); Takashi Tsuchiya, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 15/752,038

(22) PCT Filed: Aug. 8, 2016

(86) PCT No.: PCT/JP2016/073253
§ 371 (c)(1),
(2) Date: Feb. 12, 2018

(87) PCT Pub. No.: WO2017/033723
PCT Pub. Date: Mar. 2, 2017

(65) Prior Publication Data

US 2018/0241138 A1 Aug. 23, 2018

(30) Foreign Application Priority Data

Aug. 24, 2015 (JP) ..... 2015-164765

(51) Int. Cl.
*H01R 4/30* (2006.01)
*H01R 4/34* (2006.01)
(Continued)

(52) U.S. Cl.
CPC ..... *H01R 4/64* (2013.01); *H01R 4/305* (2013.01); *H01R 4/34* (2013.01); *H01R 11/12* (2013.01); *H01R 13/518* (2013.01)

(58) Field of Classification Search
CPC . H01R 4/305; H01R 4/34; H01R 4/64; H01R 11/12; H01R 13/518
See application file for complete search history.

(56) References Cited

U.S. PATENT DOCUMENTS 5,188,544 A * 2/1993 Mukai ..... H01R 11/12 439/287
5,577,927 A * 11/1996 Okada ..... H01R 4/34 439/287

(Continued)

FOREIGN PATENT DOCUMENTS

JP 2000-208172 7/2000
JP 2004-253167 9/2004

(Continued)

OTHER PUBLICATIONS

International Search Report dated Nov. 1, 2016.

*Primary Examiner* — Edwin A. Leon
*Assistant Examiner* — Oscar Jimenez
(74) *Attorney, Agent, or Firm* — Gerald E. Hespos; Michael J. Porco; Matthew T. Hespos

(57) ABSTRACT

A grounding terminal fitting (A) includes a base terminal fitting (10) having mounting holes (12, 13) and a base-side locking portion (14, 15), and a combined terminal fitting (20) separate from the base terminal fitting (10) and to be fixed while being overlapped on the base terminal fitting (10) by being locked to the base-side locking portion (14, 15). The combined terminal fitting (20) includes at least one wire connecting terminal fitting (21) formed with a through hole (23) to be aligned with the mounting hole (12, 13) for the passage of a bolt (35). A wire connecting portion (29) for connecting a grounding wire (32) and a combining locking portion (25, 26, 27, 28). When the combining locking portions (25, 26, 27, 28) are locked together, the wire connecting terminal fittings (21) are overlapped and fixed and the through holes (23) are aligned with one another.

4 Claims, 8 Drawing Sheets

(51) Int. Cl.

| | |
|---|---|
| ***H01R 4/64*** | (2006.01) |
| ***H01R 11/12*** | (2006.01) |
| ***H01R 13/518*** | (2006.01) |

(56) References Cited

U.S. PATENT DOCUMENTS

| | | | | |
|---|---|---|---|---|
| 5,759,056 | A * | 6/1998 | Costello | H01R 11/12 439/290 |
| 6,042,431 | A * | 3/2000 | Hayakawa | H01R 4/305 439/801 |
| 6,960,723 | B2 * | 11/2005 | Fujii | H01R 11/12 174/84 C |
| 7,125,295 | B2 * | 10/2006 | Zhao | H01R 11/12 439/883 |
| 7,867,044 | B2 * | 1/2011 | Lee | H01R 4/305 439/108 |
| 8,057,268 | B2 * | 11/2011 | Seng | H01R 4/305 439/792 |
| 8,105,121 | B2 * | 1/2012 | Miyamoto | H01R 4/646 439/883 |
| 8,366,499 | B2 * | 2/2013 | Shuey | H01R 11/09 439/883 |
| 9,039,435 | B2 * | 5/2015 | Horiuchi | H01R 4/64 439/287 |
| 9,397,414 | B2 * | 7/2016 | Heo | H01R 4/305 |
| 9,825,375 | B2 * | 11/2017 | Naganishi | H01R 4/185 |
| 2013/0109226 | A1 | 5/2013 | Blanchet et al. | |
| 2013/0267105 | A1 | 10/2013 | Horiuchi | |
| 2015/0099388 | A1 | 4/2015 | Nobukuni | |

FOREIGN PATENT DOCUMENTS

| | | |
|---|---|---|
| JP | 2006-40759 | 2/2006 |
| JP | 2013-257975 | 12/2013 |
| JP | 2015-76202 | 4/2015 |

* cited by examiner

GROUNDING TERMINAL FITTING

BACKGROUND

Field of the Invention

The invention relates to a grounding terminal fitting.

Description of the Related Art

Japanese Unexamined Patent Publication No. 2004-253167 discloses a grounding terminal fitting including two mounting holes and mounted on a grounding wire. The grounding terminal fitting is formed with a crimping portion in the form of an open barrel extending from an outer peripheral edge thereof, and the grounding wire is fixed to this crimping portion. The grounding terminal fitting connected to the grounding wire is mounted conductively on a ground contact surface by bolts penetrating through the two mounting holes.

The above-described grounding terminal fitting includes only one crimping portion. Thus, two grounding wires can be grounded collectively at one location by combining two grounding terminal fittings. However, even if the two grounding terminal fittings are combined, the number of the grounding wires that can be grounded at one location is limited to two.

Thought has been given to form plura crimping portions on one grounding terminal fitting. However, the grounding terminal fitting is formed of a metal plate material stamped into a predetermined shape. The crimping portion includes a crimping piece extending from an outer peripheral edge of the grounding terminal fitting and projecting in a direction intersecting an extending direction of the crimping piece (i.e. direction along the outer periphery of the grounding terminal fitting). Thus, if it is tried to increase the number of the crimping portions formed on one grounding terminal fitting, the grounding terminal fitting is enlarged by that much and an outer peripheral length of the grounding terminal fitting needs to be made longer.

The invention was completed on the basis of the above situation and aims to enable plural grounding wires to be connected without enlargement.

SUMMARY

The invention is directed to a grounding terminal fitting with a base terminal fitting including a plurality of mounting holes. Bolts constituting fastening members are passed through the mounting holes. The base terminal fitting is fixed conductively to a grounding member by fastening the fastening member. A base-side locking portion is formed on the base terminal fitting. A combined terminal fitting separate from the base terminal fitting is fixed while being overlapped on the base terminal fitting by being locked to the base-side locking portion. The combined terminal fitting includes at least one wire connecting terminal fitting that is formed with a through hole to be aligned with the mounting hole for the passage of the bolt, a wire connecting portion for connecting a grounding wire and a combining locking portion. Plura wire connecting terminal fittings are overlapped and fixed and the through holes are aligned with one another by locking the combining locking portions to one another.

Plural wire connecting portions for connecting the grounding wires are provided separately on the plurality of wire connecting terminal fittings. Thus, one wire connecting terminal fitting need not be enlarged. In addition, the wire connecting terminal fittings are overlapped with the through holes aligned. Therefore, a space for mounting the wire connecting terminal fittings can also be small. Thus, according to the invention, a plurality of grounding wires can be connected without enlargement.

A plurality of the wire connecting portions may project radially with the through holes as a center in a state where the wire connecting terminal fittings are overlapped and fixed. According to this configuration, more grounding wires can be connected as compared to the case where the wire connecting portions are arranged side by side.

The combined terminal fittings may be provided so that the through holes thereof are aligned individually with the mounting holes. According to this configuration, even more grounding wires can be connected.

The base terminal fitting may be formed with a rotation stop to be locked to the grounding member. The mounting holes may include a small-diameter mounting hole and a large-diameter mounting hole having a larger inner diameter than the small-diameter mounting hole. The small-diameter mounting hole may be disposed at a position more distant from the rotation stop than the large-diameter mounting hole. According to this configuration, in fixing the base terminal fitting to the grounding member, the rotation stop is locked to the grounding member, the bolt is passed through the small-diameter mounting hole and the fastening member is fastened. The drag rotation of the base terminal fitting due to the fastening of the fastening member is prevented by a locking action of the rotation stop. At this time, a distance between the small-diameter mounting hole and the rotation stop is relatively long. Thus, stress in the rotation stop can be small. After the fastening of the fastening member in the small-diameter mounting hole is completed, the bolt is passed through the large-diameter mounting hole and the fastening member is fastened. At this time, even if the position of the large-diameter mounting hole on the grounding member varies due to a dimensional tolerance, no trouble is caused in passing the bolt through the large-diameter mounting hole since the inner diameter of the large-diameter mounting hole is relatively large.

DETAILED DESCRIPTION

Figure 1:
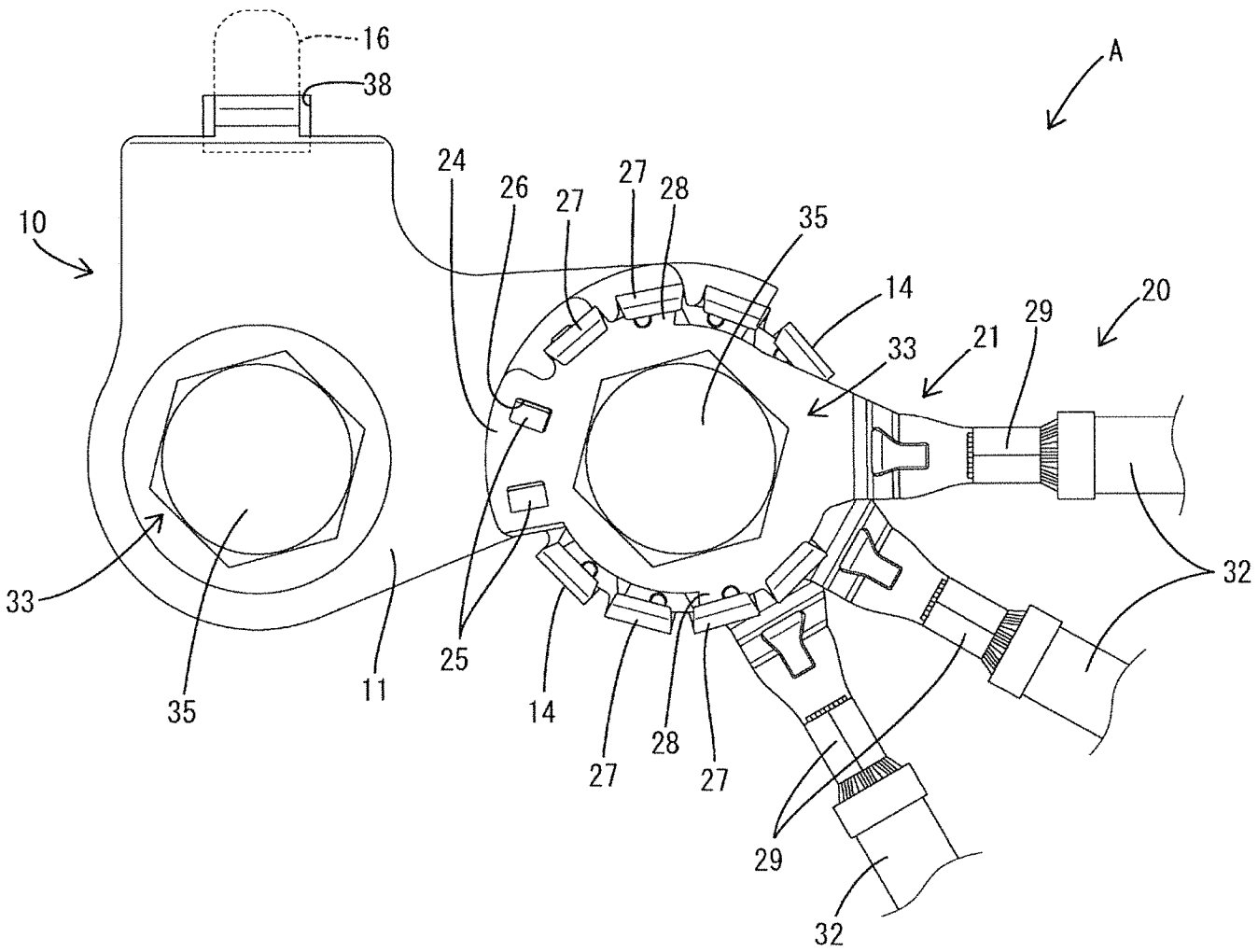
FIG. 1 is a plan view of a grounding terminal fitting of a first embodiment.
Figure 2:
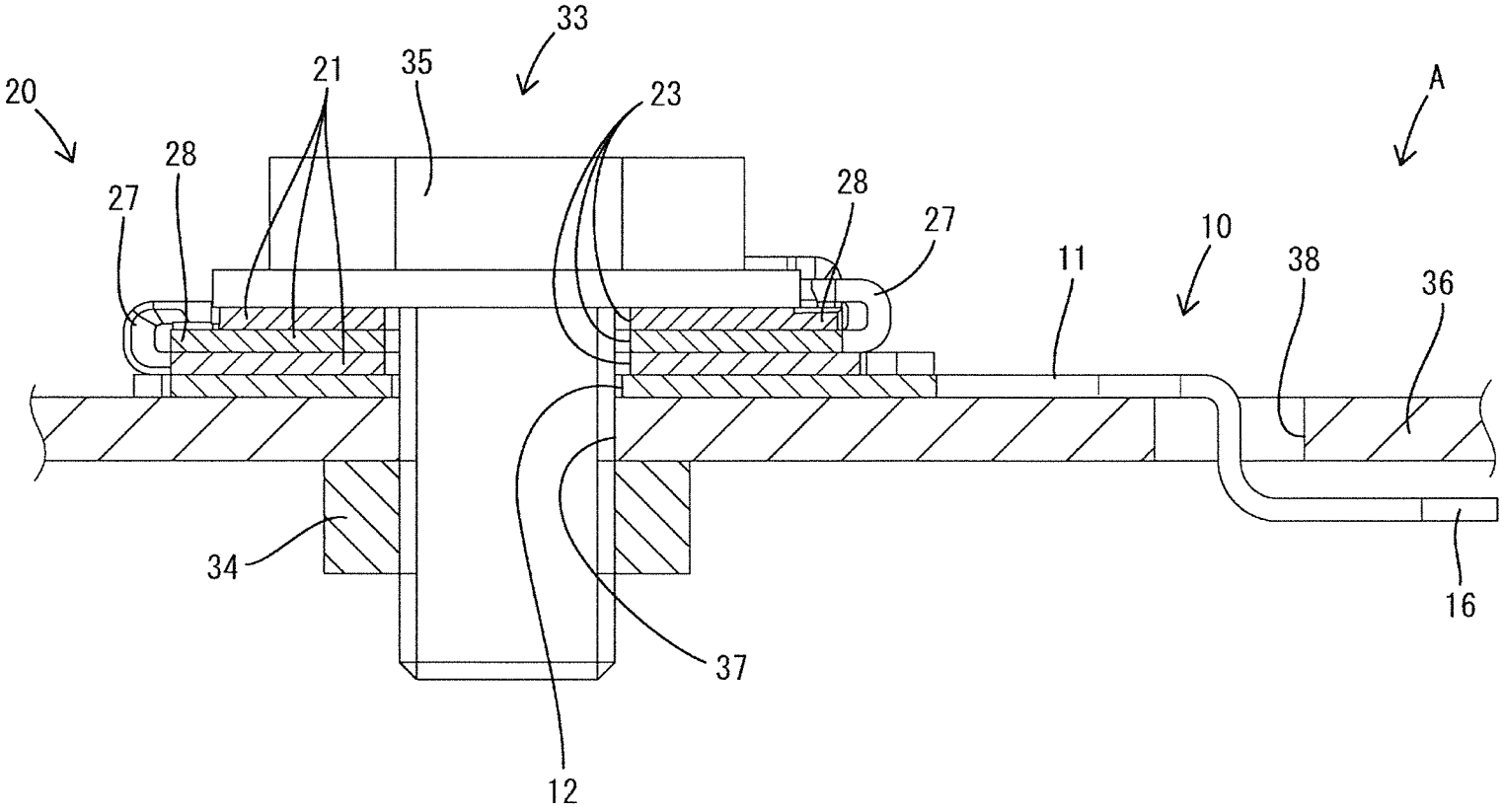
FIG. 2 is a section showing a mounting structure of the grounding terminal fitting and a grounding member.

A first embodiment of the invention is described with reference to FIGS. 1 to 8. A grounding terminal fitting A of the first embodiment is configured by assembling one base terminal fitting 10 and one combined terminal fitting 20, which is a member separate from the base terminal fitting 10. An upper side in FIG. 1 is defined as a front concerning a front-rear direction in the base terminal fitting 10. Left and right sides shown in FIG. 1 are defined as left and right sides concerning a lateral direction. Upper and lower sides shown in FIG. 2 are defined as upper and lower sides concerning a vertical direction.

Figure 4:
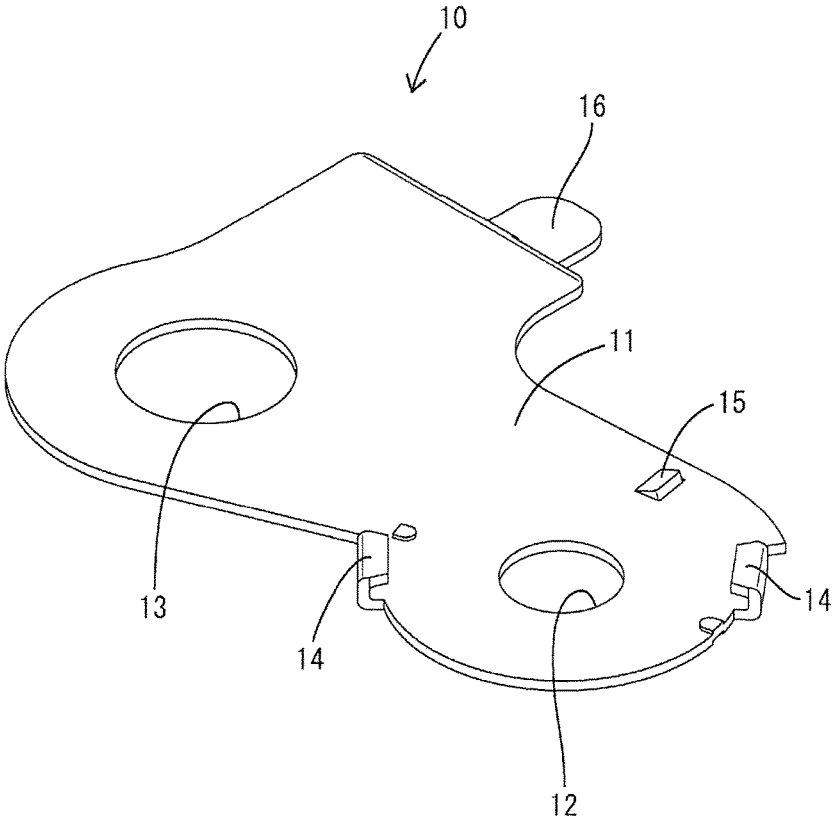
FIG. 4 is a perspective view of the base terminal fitting.
Figure 5:
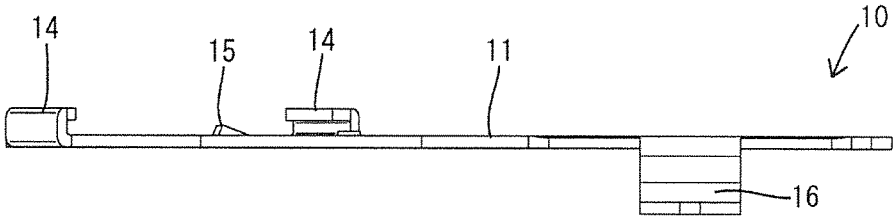
FIG. 5 is a front view of the base terminal fitting.
Figure 6:
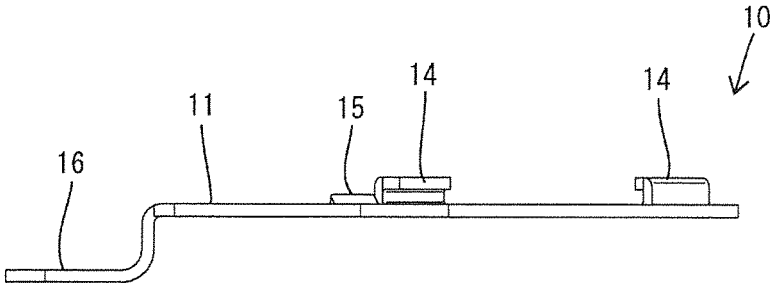
FIG. 6 is a left side view of the base terminal fitting.

The base terminal fitting 10 is formed by applying bending, stamping and the like to a metal plate material of a predetermined shape. As shown in FIGS. 4 to 6, the base terminal fitting 10 is a single component integrally formed with a base 11 in the form of a flat plate, one base-side locking projection 15 and one rotation stop 16.

As shown in FIG. 4, the base 11 is formed with a circular small-diameter mounting hole 12 and a circular large-diameter mounting hole 13 having a larger inner diameter than the small-diameter mounting hole 12. The small-diameter mounting hole 12 is disposed in a right area of the base 11 and the large-diameter mounting hole 13 is disposed in a left area of the base 11. That is, the small-diameter mounting hole 12 and the large-diameter mounting hole 13 are disposed side by side in the lateral direction.

Two base-side sandwiching portions 14 are disposed on an arcuate outer peripheral edge of the base 11 concentric with the small-diameter mounting hole 12 and symmetrically positioned across the small-diameter mounting hole 12. One base-side sandwiching portion 14 is located obliquely to the right and front of the small-diameter mounting hole 12, and the other base-side sandwiching portion 14 is located obliquely to the left and rear of the small-diameter mounting hole 12. Each base-side sandwiching portion 14 has an inverted L shape and projects up from the outer peripheral edge of the base 11, and a projecting end part projects radially in toward the small-diameter mounting hole 12.

The base 11 is formed with the base-side locking projection 15 formed by cutting a part of the base 11 and raising the cut part up. The base-side locking projection 15 is disposed in front of the small-diameter mounting hole 12. A rotation stop 16 is formed on the front edge of the base 11. The rotation stop 16 is lowered with respect to the base 11 via a step and cantilevered forward from a position of the front edge of the base 11 in front of the large-diameter mounting hole 13. The base terminal fitting 10 configured as just described is not formed with a part for connecting grounding wires 32.

Figure 7:
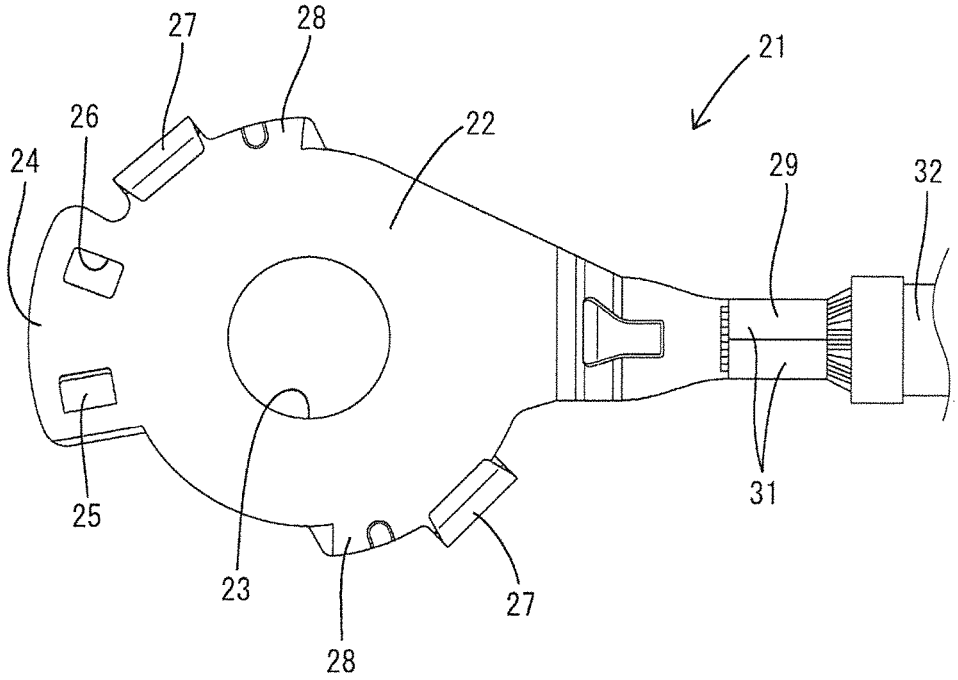
FIG. 7 is a plan view of the wire connecting terminal fitting.
Figure 8:
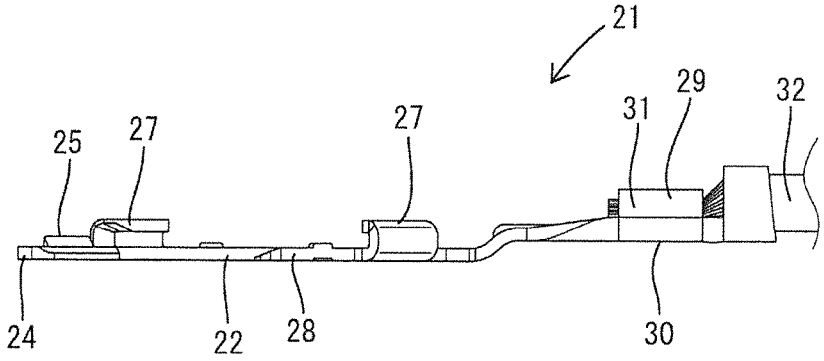
FIG. 8 is a side view of the wire connecting terminal fitting.
Figure 9:
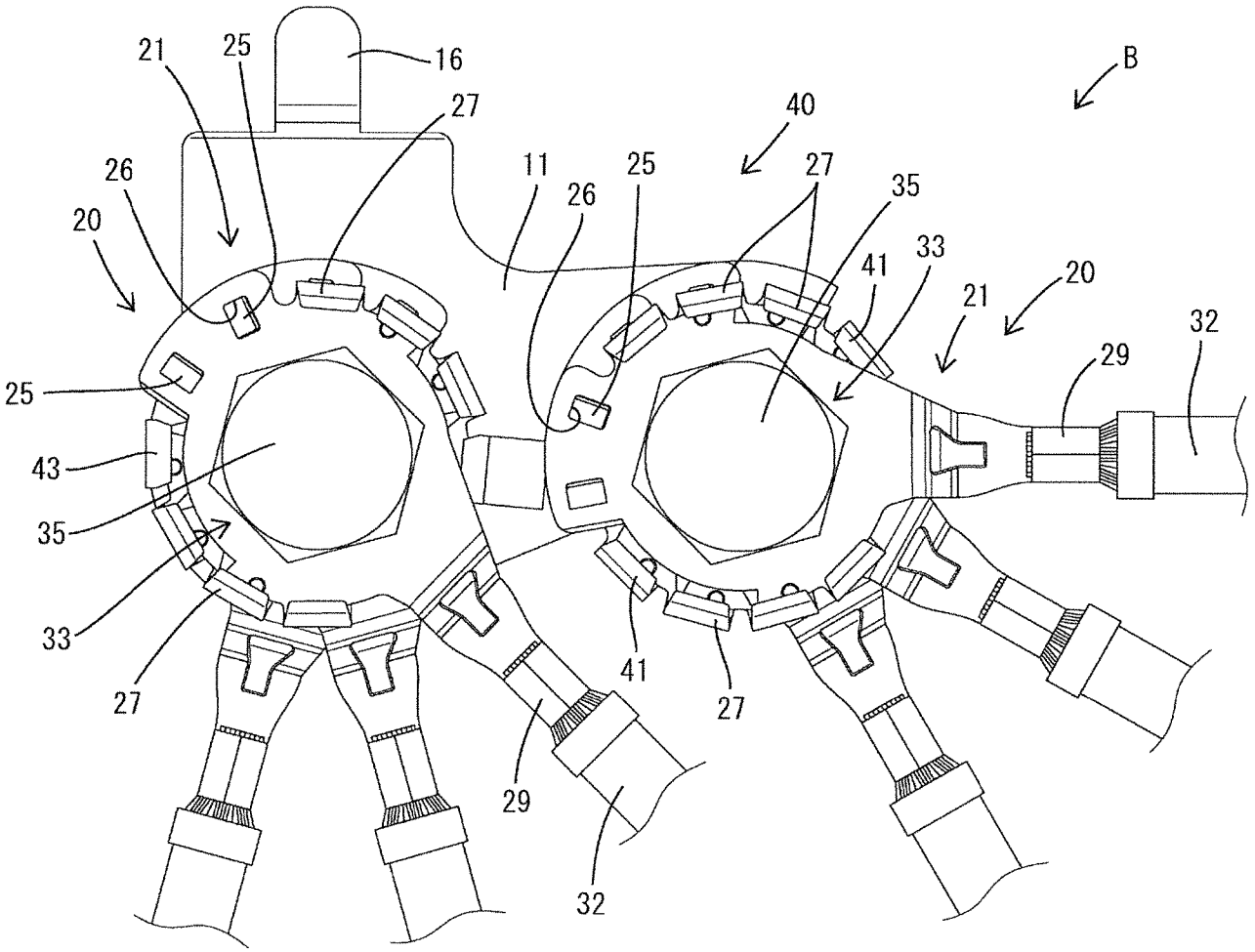
FIG. 9 is a plan view of a grounding terminal fitting of a second embodiment
Figure 10:
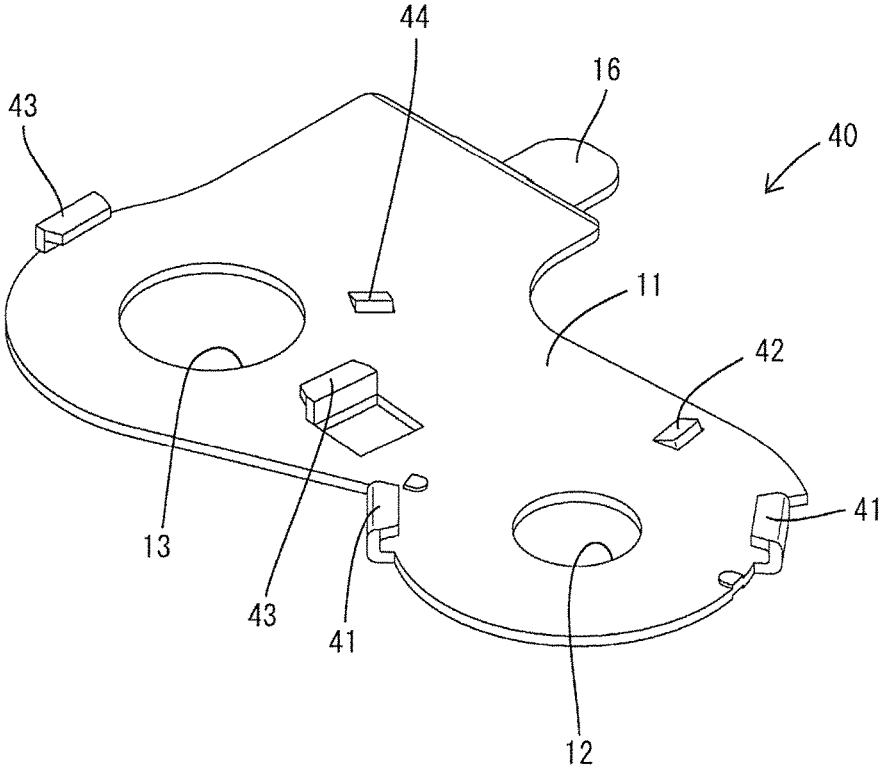
FIG. 10 is a perspective view of a base terminal fitting.
Figure 11:
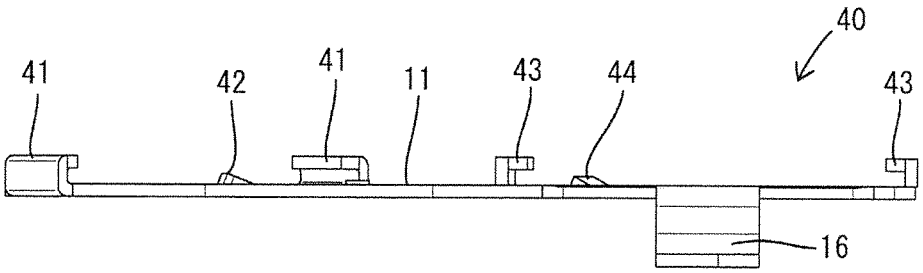
FIG. 11 is a front view of the base terminal fitting.
Figure 12:
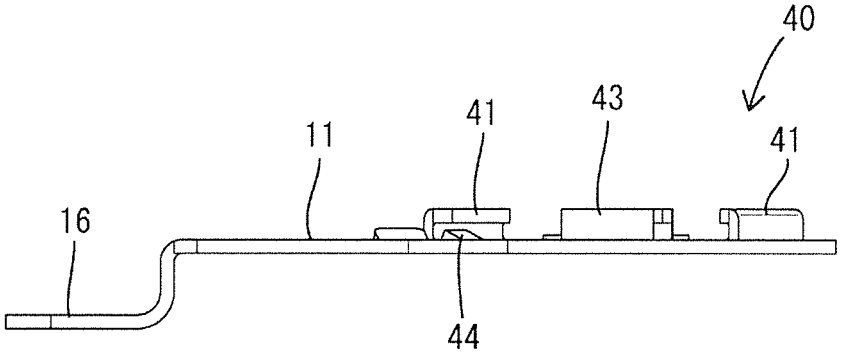
FIG. 12 is a left side view of the base terminal fitting.

The combined terminal fitting 20 is configured by assembling a plurality of wire connecting terminal fittings 21 which are identical components. A left side in FIGS. 7 and 8 is defined as a front concerning a front-rear direction in one wire connecting terminal fitting 21. An upper side in FIG. 7 is defined as a right side concerning a lateral direction. Upper and lower sides shown in FIG. 8 are defined as upper and lower sides concerning a vertical direction.

Each wire connecting terminal fitting 21 is formed by applying bending, stamping and the like to a metal plate material of a predetermined shape. As shown in FIGS. 7 and 8, the wire connecting terminal fitting 21 is a single component integrally formed with a circular terminal body 22, one combining locking projection 25, one locking hole 26, two combining sandwiching portions 27, two sandwiched portions 28 and one wire connecting portion 29.

As shown in FIG. 7, a circular through hole 23 is formed in a center of the terminal body 22. An inner diameter of the through hole 23 is substantially equal to that of the small-diameter mounting hole 12. An arcuate protruding portion 24 flatly protruding forward is formed in a front end part of the terminal body 22. The combining locking projection 25 is formed in a left area of the protruding portion 24 by cutting a part of the protruding portion 24 and raising the cut part up. The combining locking projection 25 has the same shape as the base-side locking projection 15. Further, a radial distance between a center of the through hole 23 and the combining locking projection 25 is equal to a radial distance between a center of the small-diameter mounting hole 12 and the base-side locking projection 15.

The locking hole 26 is formed in a right area of the protruding portion 24. The locking hole 26 is a substantially rectangular penetrating hole formed by cutting off the protruding portion 24. A radial distance between the center of the through hole 23 and the locking hole 26 is set equal to the radial distance between the center of the through hole 23 and the combining locking projection 25.

The combining sandwiching portions 27 are disposed on an arcuate outer peripheral edge of the terminal body 22 concentric with the through hole 23 and symmetrically positioned across the through hole 23. One combining sandwiching portion 27 is located obliquely to the right and front of the through hole 23 and the other combining sandwiching portion 27 is located obliquely to the left and rear of the through hole 23. Each combining sandwiching portion 27 has an inverted L shape and projects up from the outer peripheral edge of the terminal body 22, and a projecting end part projects radially in toward the through hole 23.

The combining sandwiching portions 27 have the same shape as the base-side sandwiching portions 14. Further, a radial distance between the center of the through hole 23 and the combining sandwiching portion 27 is equal to a radial distance between the center of small-diameter mounting hole 12 and the base-side sandwiching portions 14. The two sandwiched portions 28 are formed on the outer peripheral edge of the terminal body 22 and disposed adjacent to the combining sandwiching portions 27 in a circumferential direction.

The wire connecting portion 29 is cantilevered rearward from a rear end part of the terminal body 22. The wire connecting portion 29 is composed of a crimping portion in the form of an open barrel including a base 30 continuous and flush with the terminal body 22 and crimping pieces 31 projecting from both left and right side edges of the base 30. An end part of the grounding wire 32 constituted by a coated wire is fixed conductively by crimping with an axis oriented in the front-rear direction. The grounding wire 32 fixed to the wire connecting portion 29 is drawn rearwardly from the terminal body 22.

As shown in FIG. 2, the grounding terminal fitting A of the first embodiment is conductively fixed to a grounding member 36 by a fastening member 33. The grounding member 36 is constituted by a metal panel such as a vehicle body of an automotive vehicle. The grounding member 36 is formed with two penetrating connection holes 37 corresponding to the small-diameter mounting hole 12 and the large-diameter mounting hole 13. The fastening member 33 is composed of two nuts 34 and two bolts 35.

The two nuts 34 are fixed to the back surface of the grounding member 36, such as by welding, so as to be concentric with the respective connection holes 37. Further, the grounding member 36 is formed with a stopper 38 for locking the rotation stop 16. The stopper 38 penetrates from the front surface to the back surface of the grounding member 36. When the two mounting holes 12, 13 are aligned with the two connection holes 37, the rotation stop 16 is disposed at a position to be lockable to the stopper 38.

Figure 3:
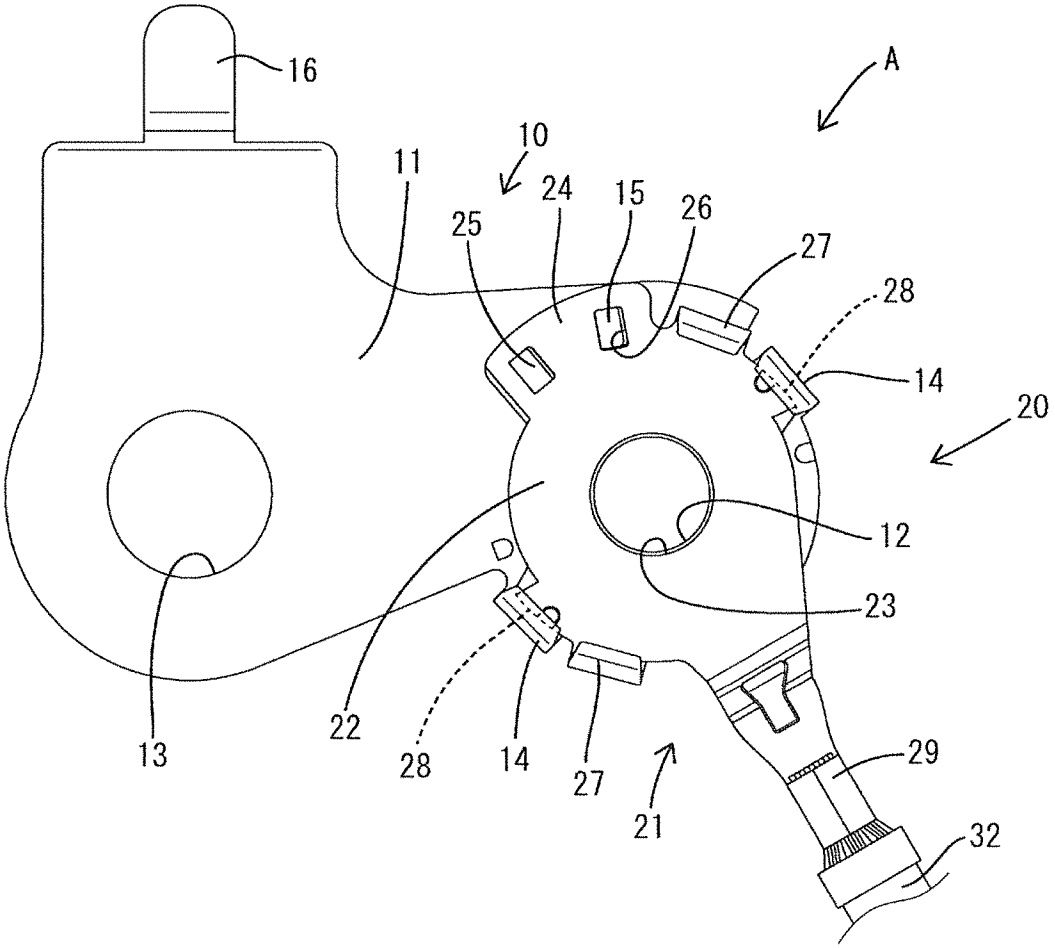
FIG. 3 is a plan view showing a state where one wire connecting terminal fitting is assembled with a base terminal fitting.

Next, a working process of mounting the grounding terminal fitting A of the first embodiment on the grounding member 36 is described. First, as shown in FIGS. 7 and 8, the end part of the grounding wire 32 is fixed to the wire connecting portion 29 of each wire connecting terminal fitting 21. Subsequently, as shown in FIG. 3, one wire connecting terminal fitting 21 is assembled with the base terminal fitting 10. In assembling, the wire connecting terminal fitting 21 is overlapped on the upper surface of the base 11 of the base terminal fitting 10 and the through hole 23 is positioned to be concentric with the small-diameter mounting hole 12.

While the small-diameter mounting hole 12 and the through hole 23 are kept concentric, the wire connecting terminal fitting 21 is rotated relative to the base terminal fitting 10 with the through hole 23 and the small-diameter mounting hole 12 as a support. When the base terminal fitting 10 and the wire connecting terminal fitting 21 reach a properly assembled state, the sandwiched portions 28 are sandwiched between the base 11 and the two base-side sandwiching portions 14 and the locking hole 26 is locked to the base-side locking projection 15. By these sandwiching structure and locking structure, the base terminal fitting 10 and the wire connecting terminal fitting 21 are held assembled with relative displacements in the vertical and horizontal directions restricted.

Thereafter, the terminal body 22 of another wire connecting terminal fitting 21 is overlapped on the upper surface of the terminal body 22 of the wire connecting terminal fitting 21 assembled with the base terminal fitting 10 and positioned such that the through holes 23 become concentric. While the through holes 23 are kept concentric, the upper wire connecting terminal fitting 21 is rotated relative to the lower wire connecting terminal fitting 21 and the base terminal fitting 10. When the upper and lower wire connecting terminal fittings 21 reach a properly assembled state, the two sandwiched portions 28 of the upper wire connecting terminal fitting 21 are sandwiched between the terminal body 22 of the lower wire connecting terminal fitting 21 and the two combining sandwiching portions 27 of the lower wire connecting terminal fitting 21. Together with this, the locking hole 26 of the upper wire connecting terminal fitting 21 and the combining locking projection 25 of the lower wire connecting terminal fitting 21.

These sandwiching structure and locking structure hold the upper and lower wire connecting terminal fittings 21 assembled with relative displacements in the vertical and horizontal directions restricted. With two wire connecting terminal fittings 21 assembled one above the other, the wire connecting portion 29 of the upper wire connecting terminal fitting 21 and the wire connecting portion 29 of the lower wire connecting terminal fitting 21 project radially out from circumferentially displaced positions. Thus, the grounding wires 32 fixed to these wire connecting portions 29 also are drawn radially out from circumferentially different positions.

By overlapping the wire connecting terminal fittings 21 one above another in the same procedure as the above one, the combined terminal fitting 20 is configured and the grounding terminal fitting A in which the combined terminal fitting 20 and the base terminal fitting 10 are integrated is configured. Note that although the wire connecting terminal fittings 21 are overlapped on and assembled with the base terminal fitting 10 one by one in the first embodiment, an assembling procedure is not limited to this method. Specifically, it is also possible to configure the combined terminal fitting 20 by assembling all the wire connecting terminal fittings 21 with one another and, thereafter, mount this combined terminal fitting 20 on the base terminal fitting 10.

After assembling the base terminal fitting 10 and all the wire connecting terminal fittings 21, the rotation stop portion 16 is hooked to penetrate through the stopper 28 and the two mounting holes 12, 13 are aligned with two connection holes 37. Then, the bolt 35 is inserted into the small-diameter mounting hole 12 and the through holes 23 from above the grounding terminal fitting A and a shaft of the bolt 35 is screwed into the nut 34. When a head of the bolt 35 being screwed in contacts the upper surface of the uppermost wire connecting terminal fitting 21, a rotational force then is applied to the grounding terminal fitting A with the small-diameter mounting hole 12 and the through holes 23 as a supporting point by frictional resistance between the head and the wire connecting terminal fitting 21.

However, the rotation stop 16 is locked to the stopper 38, the grounding terminal fitting A is not dragged to rotate even if the bolt 35 is screwed in. After the grounding terminal fitting A is fixed to the grounding member 36 in the small-diameter mounting hole 12, the other bolt 35 is inserted into the large-diameter mounting hole 13 and screwed into the nut 34. In the above way, the grounding terminal fitting A is fixed reliably to the grounding member 36 by the two bolts 35.

The grounding terminal fitting A of the first embodiment includes the base terminal fitting 10 and the combined terminal fitting 20 separate from the base terminal fitting 10. The base terminal fitting 10 includes the mounting holes 12, 13 through which the bolts 35 constituting the fastening member 33 are passed, and is fixed conductively to the grounding member 36 by fastening the fastening member 33 (bolts 35). The base terminal fitting 10 is formed with the base-side locking portion (base-side sandwiching portions 14, base-side locking projection 15). The combined terminal fitting 20 is fixed while being overlapped on the upper surface of the base terminal fitting 10 by being locked to the base-side locking portion. The combined terminal fitting 20 includes at least one wire connecting terminal fitting 21.

The wire connecting portion 21 is formed with the through hole 23 that is aligned with the small-diameter mounting hole 12 and through which the bolt 35 is passed, the wire connecting portion 29 for connecting the grounding wire 32 and the combining locking portion (combining sandwiching portions 27, combining locking projection 25, locking hole 26, sandwiched portions 28). The wire connecting terminal fittings 21 are fixed to each other while being overlapped one above the other and the through holes 23 thereof are aligned by locking the combining sandwiching portions 27 and the sandwiched portions 28 and locking the combining locking projection 25 and the locking hole 26.

Plural wire connecting portions 29 for connecting the grounding wires 32 are provided separately on a plurality of wire connecting terminal fittings 21 in the grounding terminal fitting A of the first embodiment. Thus, one wire connecting terminal fitting 21 need not be enlarged. In addition, since the wire connecting terminal fittings 21 are overlapped with the through holes 23 aligned, a space for mounting the wire connecting terminal fittings 21 can also be small. Thus, according to the grounding terminal fitting A of the first embodiment, a plurality of grounding wires 32 can be connected without enlargement.

Further, in a state where the wire connecting terminal fittings 21 are overlapped and fixed, the wire connecting portions 29 are disposed to radially project with the through holes 23 as a center. According to this configuration, more grounding wires 32 can be connected as compared to the case where the wire connecting portions 29 are disposed side by side.

Further, the base terminal fitting 10 is formed with the rotation stop 16 to be locked to the grounding member 36, and the mounting holes 12, 13 include the small-diameter mounting hole 12 and the large-diameter mounting hole 13 having a larger inner diameter than the small-diameter mounting hole 12. The small-diameter mounting hole 12 is disposed at a position more distant from the rotation stop 16 than the large-diameter mounting hole 13. According to this configuration, in fixing the base terminal fitting 10 to the grounding member 36, the rotation stop 16 is locked to the grounding member 36 and the bolt 35 of the fastening member 33 is passed through the small-diameter mounting hole 12 and fastened. The drag rotation of the base terminal fitting 10 due to the fastening of the bolt 35 is prevented by a locking action of the rotation stop 16.

At this time, since a distance between the small-diameter mounting hole 12 and the rotation stop 16 is relatively long, stress in the rotation stop 16 can be small. After the fastening of the bolt 35 in the small-diameter mounting hole 12 is completed, the bolt 35 is passed through the large-diameter mounting hole 13 and fastened. At this time, even if the position of the large-diameter mounting hole 13 on the grounding member 36 varies due to a dimensional tolerance, no trouble such as getting caught is caused in passing the bolt 35 through the large-diameter mounting hole 13 since the inner diameter of the large-diameter mounting hole 13 is relatively large.

Next, a second embodiment of the invention is described with reference to FIGS. 9 to 12. In a grounding terminal fitting B of the second embodiment, a base terminal fitting 40 is configured differently from that of the above first embodiment. Further, the number of combined terminal fittings 20 be assembled with the base terminal fitting 40 is different from that of the first embodiment. Since the other configurations are the same as in the first embodiment, the same components are denoted by the same reference signs and the structures, functions and effects thereof are not described.

In the first embodiment, the base-side sandwiching portions 14 and the base-side locking projection 15 are formed to correspond only to the small-diameter mounting hole 12 out of the small-diameter mounting hole 12 and the large-diameter mounting hole 13. In contrast, the base terminal fitting 40 of the second embodiment is formed with a pair of base-side second sandwiching portions 43 and a base-side second locking projection 44 corresponding to the large-diameter mounting hole 13 in addition to a pair of base-side first sandwiching portions 41 and a base-side first locking projection 42 corresponding to the small-diameter mounting hole 12.

The shapes of the base-side first sandwiching portions 41 and the base-side first locking projection 42 and a positional relationship of the base-side first sandwiching portions 41 and the base-side first locking projection 42 with respect to the small-diameter mounting hole 12 are the same as those of the base-side sandwiching portions 14 and the base-side locking projection 15 of the first embodiment. Further, the base-side second sandwiching portions 43 are disposed across the large-diameter mounting hole 13 in the lateral direction. The left base-side second sandwiched portion 43 projects up on an outer peripheral edge of a base, whereas the right base-side second sandwiching portion 43 is formed by cutting and raising a part of the base 11. The base-side second locking projection 44 is disposed obliquely to the right and front of the large-diameter mounting hole 13.

A radial distance from a center of the small-diameter mounting hole 12 to the base-side first sandwiching portions 41 and a radial distance from a center of the large-diameter mounting hole 13 to the base-side second sandwiching portions 43 is equal to the radial distance from the center of the small-diameter mounting hole 12 to the base-side sandwiching portions 14 in the first embodiment. Further, a radial distance from the center of the small-diameter mounting hole 12 to the base-side first locking projection 42 and a radial distance from the center of the large-diameter mounting hole 13 to the base-side second locking projection 44 are equal to the radial distance from the center of the small-diameter mounting hole 12 to the base-side locking projection 15 in the first embodiment.

In the grounding terminal fitting B of the second embodiment, the combined terminal fitting 20 can be assembled not only concentrically with the small-diameter mounting hole 12, but also concentrically with the large-diameter mounting hole 13. Further, the combined terminal fitting 20 can also be assembled concentrically with the large-diameter mounting hole 13 without being assembled with the small-diameter mounting hole 12.

In the grounding terminal fitting B of the second embodiment, two combined terminal fittings 20 can be provided to individually align through holes thereof with two mounting holes 12, 13. Thus, even more grounding wires 32 can be connected as compared to the case where the combined terminal fitting 20 is assembled with only either one of the mounting holes 12, 13.

The invention is not limited to the above described and illustrated embodiments. For example, the following embodiments also are included in the scope of the invention.

Although the wire connecting portion is the crimping portion in the form of an open barrel in the above embodiments, the wire connecting portion may connect the grounding wire by means other than crimping.

Although the combined terminal fitting is composed of the plurality of wire connecting terminal fittings in the above embodiments, the number of the wire connecting terminal fittings constituting the combined terminal fitting may be one.

Although the plurality of wire connecting portions are disposed to radially project with the through holes as a center in the above embodiments, there is no limitation to this and the plurality of wire connecting portions may be disposed side by side substantially in parallel to each other.

Although the base terminal fitting is formed with two mounting holes in the above embodiments, three or more mounting holes may be formed in the base terminal fitting.

Although the base terminal fitting is formed with the rotation stop portion to be locked to the grounding member in the above embodiments, the base terminal fitting may not be formed with the rotation stop portion.

Although the bolts are screwed into the nuts of the grounding member in the above embodiments, stud bolts standing on the grounding member may be passed through the mounting holes.

Although the plurality of mounting holes include the small-diameter mounting hole and the large-diameter mounting hole having different inner diameters in the above embodiments, all of the plurality of mounting holes may have the same inner diameter.

LIST OF REFERENCE SIGNS

A . . . grounding terminal fitting
B . . . grounding terminal fitting

10 . . . base terminal fitting
12 . . . small-diameter mounting hole
13 . . . large-diameter mounting hole
14 . . . base-side sandwiching portion (base-side locking portion)
15 . . . base-side locking projection (base-side locking portion)
16 rotation stop
20 . . . combined terminal fitting
21 . . . wire connecting terminal fitting
23 . . . through hole
25 . . . combining locking projection (combining locking portion)
26 . . . locking hole (combining locking portion)
27 . . . combining sandwiching portion (combining locking portion)
28 . . . sandwiched portion (combining locking portion)
29 . . . wire connecting portion
32 . . . grounding wire
33 . . . fastening member
35 . . . bolt
36 . . . grounding member
40 . . . base terminal fitting
41 . . . base-side first sandwiching portion (base-side locking portion)
42 . . . base-side first locking projection (base-side locking portion)
43 . . . base-side second sandwiching portion (base-side locking portion)
44 . . . base-side second locking projection (base-side locking portion)

The invention claimed is:

1. A grounding terminal fitting, comprising:

a base terminal fitting including mounting holes and not formed with a part for connecting grounding wires, bolts constituting a fastening member being passed through the mounting holes, the base terminal fitting being conductively fixed to a grounding member by fastening the fastening member;

a base-side locking portion formed on the base terminal fitting; and a combined terminal fitting separate from the base terminal fitting, the combined terminal fitting being fixed while being overlapped on the base terminal fitting by being locked to the base-side locking portion, wherein:

the combined terminal fitting includes a plurality of wire connecting terminal fittings;

each of the wire connecting terminal fittings is formed with a through hole to be aligned with the mounting hole for the passage of the bolt, a wire connecting portion for connecting the grounding wire and a combining locking portion;

the base terminal fitting and the wire connecting terminal fitting are assembled by being relatively rotated with the mounting hole and the through hole as a support;

the wire connecting terminal fittings are fixed while being overlapped with one another by aligning the through holes and being relatively rotated about the through holes to lock the combining locking portions to one another; and a plurality of the wire connecting portions are disposed to project radially with the through holes as a center in a state where the plurality of wire connecting terminal fittings are overlapped and fixed.

2. The grounding terminal fitting of claim 1, wherein a plurality of the combined terminal fittings are provided so that the through holes thereof are individually aligned with the plurality of mounting holes.

3. The grounding terminal fitting of claim 2, wherein:

the base terminal fitting is formed with a rotation stop to be locked to the grounding member;

the mounting holes include a small-diameter mounting hole and a large-diameter mounting hole having a larger inner diameter than the small-diameter mounting hole; and the small-diameter mounting hole is disposed at a position more distant from the rotation stop than the large-diameter mounting hole.

4. The grounding terminal fitting of claim 1, wherein:

the base terminal fitting is formed with a rotation stop to be locked to the grounding member;

the mounting holes include a small-diameter mounting hole and a large-diameter mounting hole having a larger inner diameter than the small-diameter mounting hole; and the small-diameter mounting hole is disposed at a position more distant from the rotation stop than the large-diameter mounting hole.

* * * * *